US006877418B2

(12) United States Patent
Ishizaki

(10) Patent No.: US 6,877,418 B2
(45) Date of Patent: Apr. 12, 2005

(54) SHOE FOR A HYDRAULIC APPARATUS AND MANUFACTURING METHOD THEREOF

(75) Inventor: Yoshitomo Ishizaki, Kyotanabe (JP)

(73) Assignee: Takako Industries, Inc., Kyoto (JP)

( * ) Notice: Subject to any disclaimer, the term of this patent is extended or adjusted under 35 U.S.C. 154(b) by 0 days.

(21) Appl. No.: 10/438,872

(22) Filed: May 16, 2003

(65) Prior Publication Data

US 2004/0060433 A1 Apr. 1, 2004

(30) Foreign Application Priority Data

Sep. 26, 2002 (JP) ..... 2002-280279

(51) Int. Cl.[7] ..... F01B 3/00
(52) U.S. Cl. ..... 92/71; 29/898.041; 29/898.043
(58) Field of Search ..... 92/71, 72; 29/898.041, 29/898.043

(56) References Cited

U.S. PATENT DOCUMENTS 3,866,518 A * 2/1975 Miyao et al. ..... 91/488
5,983,776 A 11/1999 Hansell

FOREIGN PATENT DOCUMENTS

JP 2000170645 6/2000

* cited by examiner

*Primary Examiner*—F. Daniel Lopez
(74) *Attorney, Agent, or Firm*—Stevens, Davis, Miller & Mosher, LLP

(57) ABSTRACT

The invention provides a shoe for a hydraulic apparatus and manufacturing method thereof, by which production cost can be lowered without making a sliding-contact surface uneven by a welding process.

The shoe comprises a main body (10) provided on one side (10*a*) thereof with a concave spherical surface (12) to which a sphere is slidably engaged, and on the opposite side (10*b*) thereof with a locking portion (14) and a sliding-contact plate (11) provided with an engaging portion (20) by which to be engaged with the locking portion (14) to make contact with the opposite side (10*b*), wherein the sliding-contact plate (11) comprises a first layer (18) to make contact with the opposite side (10*b*) and a second layer (19) laminated on a region of the first layer (18) leaving uncovered welding portion (21) so that its surface serves as a sliding-contact surface (19*a*), and the first layer (18) is welded to the main body (10) at the welding portion (21). The locking portion (14) is a protruding portion located at a central portion of the opposite side (10*b*) of the main body (10), and the engaging portion (20) is a bore portion by which to be engaged with the protruding portion.

6 Claims, 19 Drawing Sheets

PRIOR ART

PRIOR ART

PRIOR ART

SHOE FOR A HYDRAULIC APPARATUS AND MANUFACTURING METHOD THEREOF

BACKGROUND OF THE INVENTION

1. Field of the Invention

The present invention relates to a shoe for a hydraulic apparatus, and manufacturing method thereof.

2. Description of the Related Art

A conventional shoe used in a hydraulic apparatus such as a swash plate type axial piston pump and disposed between a piston and a swash plate was manufactured according to steps shown in FIGS. 36 through 47. Specifically, FIG. 36 shows a material to be processed, provided with a sliding-contact plate laminated on one surface thereof in one united body. FIGS. 37, 38 show two turning steps on an NC lathe; FIGS. 39, 40 show a process of welding a sphere to the main body; FIG. 41 shows a process of scraping an end portion of the sphere to make a bore; FIG. 42 shows a heat treatment (soft nitriding by gas) process and vibrating barrel process. The following FIGS. 43, 44 show two process of punching the sphere and the main body; FIG. 45 shows a process of scraping an end portion on an NC lathe; FIG. 46 shows a process of lapping a surface; and FIG. 47 shows a process of combining with a piston.

However, since such conventional manufacturing process consists of processing a main body laminated with a sliding-contact plate in order to manufacture a shoe, it has disadvantages such as large dimensions of the material to be processes, considerable material loss through the process, complication of manufacturing process, etc. all of which leads to a high production cost.

On the other hand, a method was proposed wherein a main body and a sliding-contact plate are separated, and the sliding-contact plate is processed to become a bimetal and fitted to the main body (as disclosed in JP-A No.2000-170645), however the sliding-contact plate is prone to come off from the main body because of vibration etc. during operation, since the sliding-contact plate is merely fitted to the main body. This could lead to an idea of welding the sliding-contact plate to the main body, but such method is not preferable either because the sliding-contact surface may become uneven owing to the welding process.

SUMMARY OF THE INVENTION

It is an object of the present invention to provide a shoe for a hydraulic apparatus and manufacturing method thereof, by which production cost can be lowered without making a sliding-contact surface uneven by a welding process.

The invention provides a shoe for a hydraulic apparatus, comprising a main body provided on one side thereof with a concave spherical surface to which a sphere is slidably engaged or a sphere, and on the opposite side thereof with either a recessed or protruding locking portion; and a sliding-contact plate provided with an engaging portion by which to be engaged with the locking portion to make contact with the opposite side; wherein the sliding-contact plate comprises a first layer that makes contact with the opposite side of the main body and a second layer laminated on a region of the first layer leaving uncovered a prescribed welding portion so that its surface serves as a sliding-contact surface; and the first layer is welded to the main body at the prescribed welding portion.

As a result of such constitution, since the main body and the sliding-contact plate having a laminated structure are separated and a shoe is formed through engaging and welding the both parts, material loss is reduced and manufacturing process of the main body is simplified, besides assembling process becomes easier therefore manufacturing cost can be lowered. Further, since the sliding-contact plate is welded to the main body at a prescribed welding portion of the first layer, the sliding-contact surface of the second layer does not become uneven owing to the welding process.

The invention also provides a shoe for a hydraulic apparatus of the foregoing constituents, wherein the locking portion is a protruding portion located at a central portion of the opposite side of the main body, and the engaging portion is a bore portion by which to be engaged with the protruding portion.

The invention also provides a shoe for a hydraulic apparatus of the foregoing constituents, wherein the bore portion is formed on the first layer and the second layer, and a bore diameter of the second layer is greater than a bore diameter of the first layer, and the welding portion of the first layer are located inside an inner circumferential portion of the second layer.

The invention also provides a shoe for a hydraulic apparatus of the foregoing constituents, wherein the opposite side of the main body is a plain surface, and the sliding-contact plate is plastically deformed so that a surface of the first layer becomes concave and a surface of the second layer convex, and such sliding-contact plate is pressed against the opposite side of the main body in a flat shape to remain in contact with the opposite side.

By such constituents, since perimetrical portions of the sliding-contact plate is under a pressing force applied in a direction of the opposite side of the main body, the perimetrical portions of the sliding-contact plate can be prevented from bending backward to be separated from the opposite side of the main body during operation.

The invention also provides a shoe for a hydraulic apparatus of the foregoing constituents, wherein the welding portion correspond to a contacting portion of the protruding portion and the bore portion of the first layer.

The invention also provides method for manufacturing a shoe for a hydraulic apparatus, comprising the steps of: manufacturing a main body provided on one side thereof with a concave spherical surface or a sphere to which a sphere is slidably engaged and on the opposite side thereof with either recessed or protruding locking portion; manufacturing a sliding-contact plate comprising a first layer that makes contact with the opposite side of the main body and a second layer laminated on a region of the first layer except prescribed welding portion so that its surface serves as a sliding-contact surface, and having an engaging portion by which to be engaged with the locking portion at least in the first layer; and engaging the engaging portion of the sliding-contact plate with the locking portion of the main body and welding the prescribed portions of the first layer to the main body.

DESCRIPTION OF THE PREFERRED EMBODIMENTS

Referring to FIGS. 1 through 11, a hydraulic apparatus shoe and manufacturing method thereof according to the first preferred embodiment of the present invention shall be described hereunder.

Figure 11:
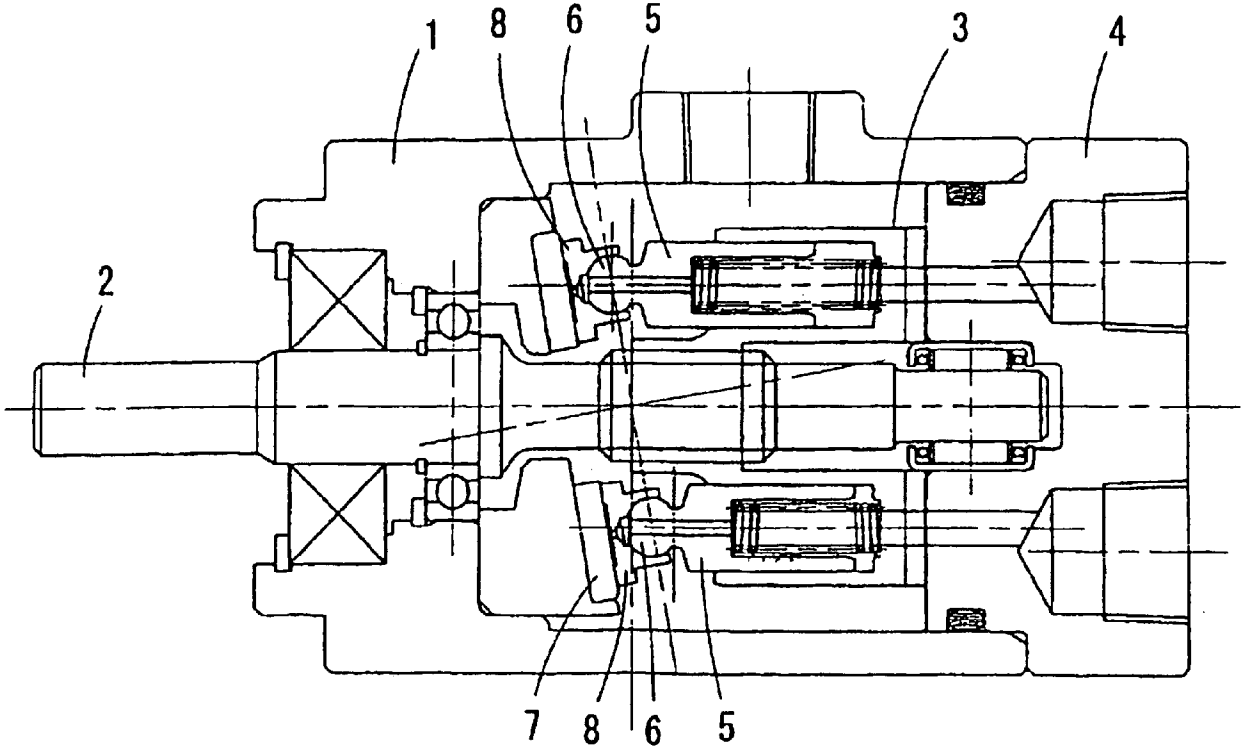
FIG. 11 is a cross-sectional view of a hydraulic apparatus.
Figure 12:
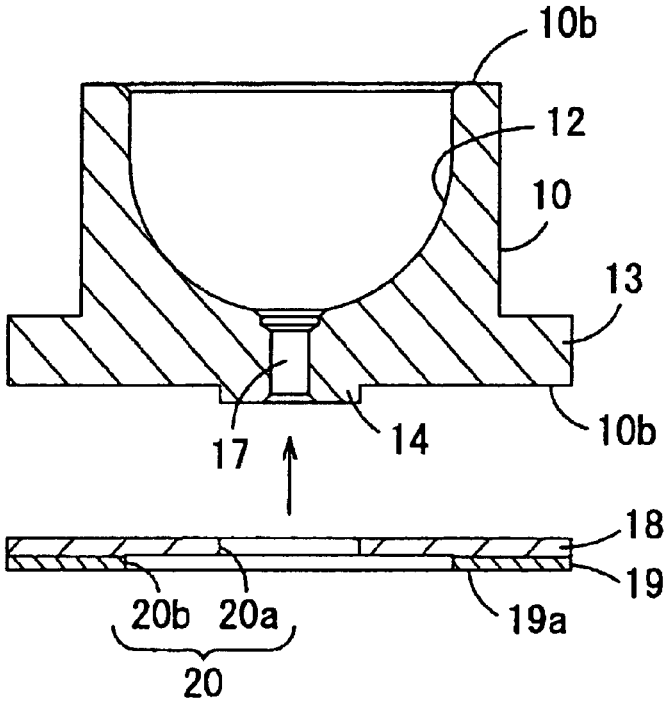
FIG. 12 is a cross-sectional view of a hydraulic apparatus shoe before welding a sliding-contact plate, according to the second embodiment of the invention.
Figure 13:
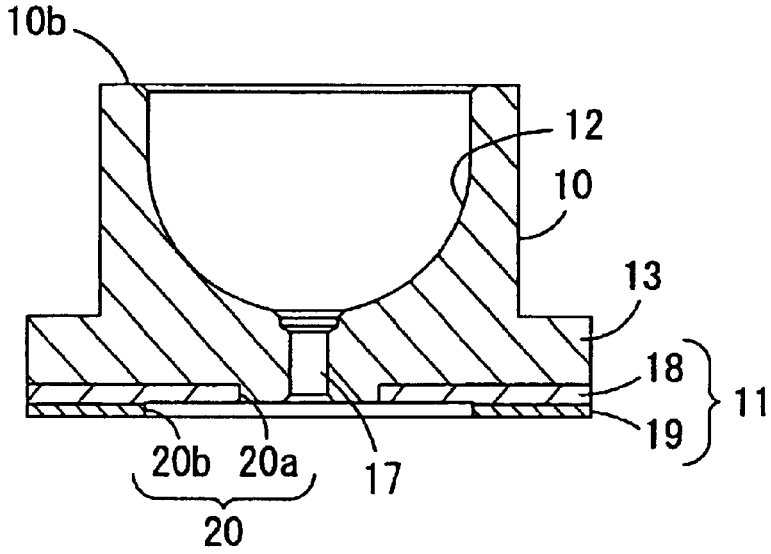
FIG. 13 is a cross-sectional view of FIG. 12 after welding.
Figure 14:
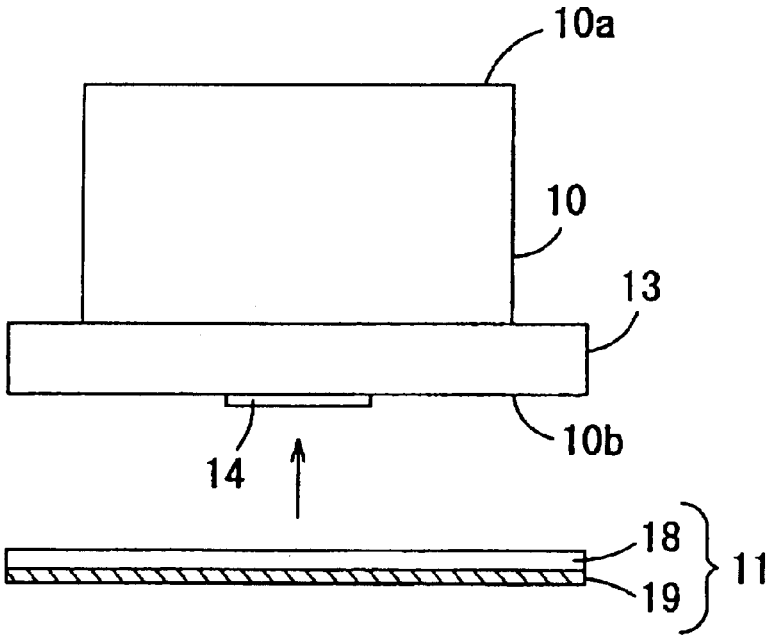
FIG. 14 is a lateral view of a hydraulic apparatus shoe before welding a sliding-contact plate.
Figure 15:
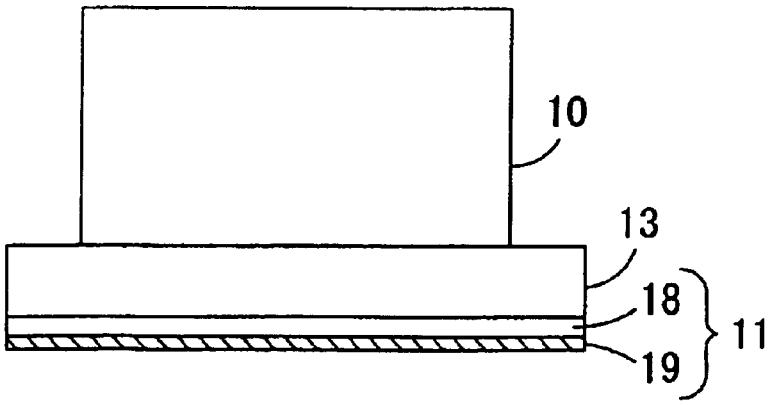
FIG. 15 is a lateral view of FIG. 14 after welding.
Figure 17:
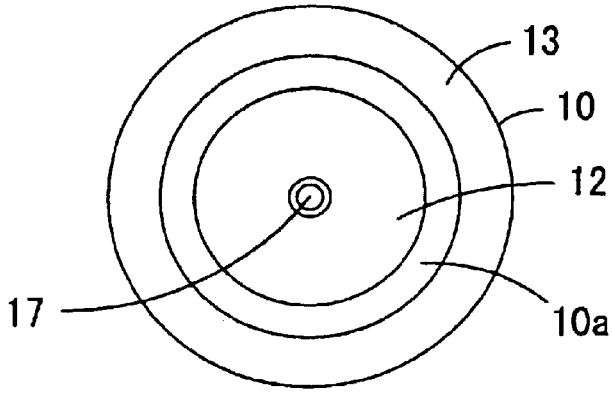
FIG. 17 is a plane view of FIG. 16.
Figure 16:
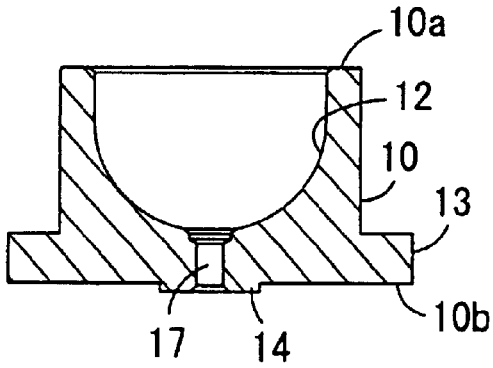
FIG. 16 is a cross-sectional view of a main body.
Figure 18:
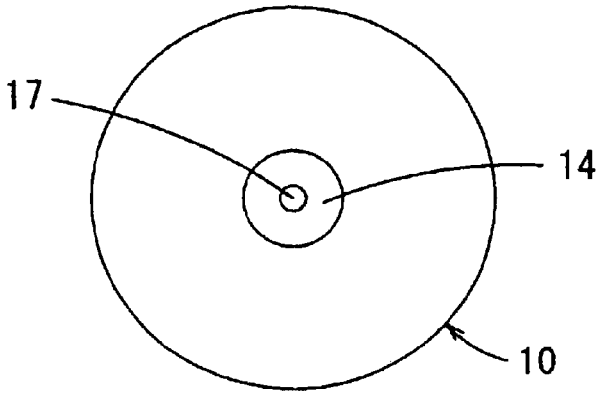
FIG. 18 is a bottom view of FIG. 16.
Figure 20:
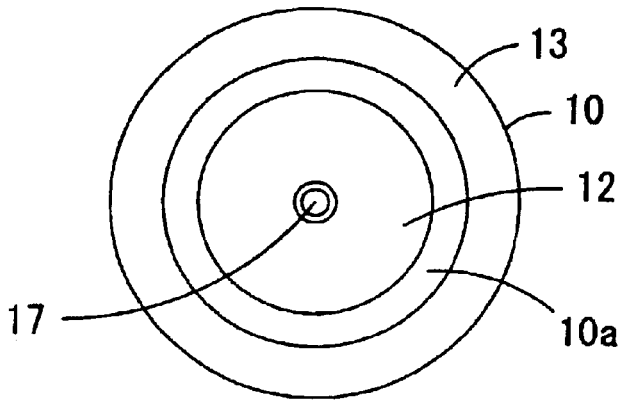
FIG. 20 is a plane view of FIG. 19.

Firstly, FIG. 11 shows an entire swash plate type axial piston pump. Referring to FIG. 11, reference numeral 1 denotes a case, numeral 2 a shaft supported by a bearing incorporated in the case 1, numeral 3 a cylinder unit attached to the shaft 2, numeral 4 a case cover provided with an inlet valve and an exhaust valve configured to communicate with the cylinder unit 3, numeral 5 pistons spring-energized in a direction to project out of the cylinder unit 3, numeral 6 a sphere disposed at an end of the piston 5, numeral 7 a swash plate fixed in the case 1 so as to confront the sphere 6, and numeral 8 denotes a shoe for sliding-contacting with the swash plate 7 and provided with a concave spherical surface for introducing the sphere 6.

When the shaft 2 is caused to rotate by a motor (not shown) etc. the cylinder unit 3 concurrently rotates, by which the piston 5 and the shoe 8 also rotate and the shoe 8 makes sliding-contact with the swash plate 7. Accordingly when the shaft 2 completes one rotation the respective pistons 5 make a round trip in a reciprocating motion within the cylinder unit 3, during which process the piston serves to aspirate a fluid into the cylinder unit 3 through the inlet valve and to discharge the fluid through the exhaust valve.

Figure 1:
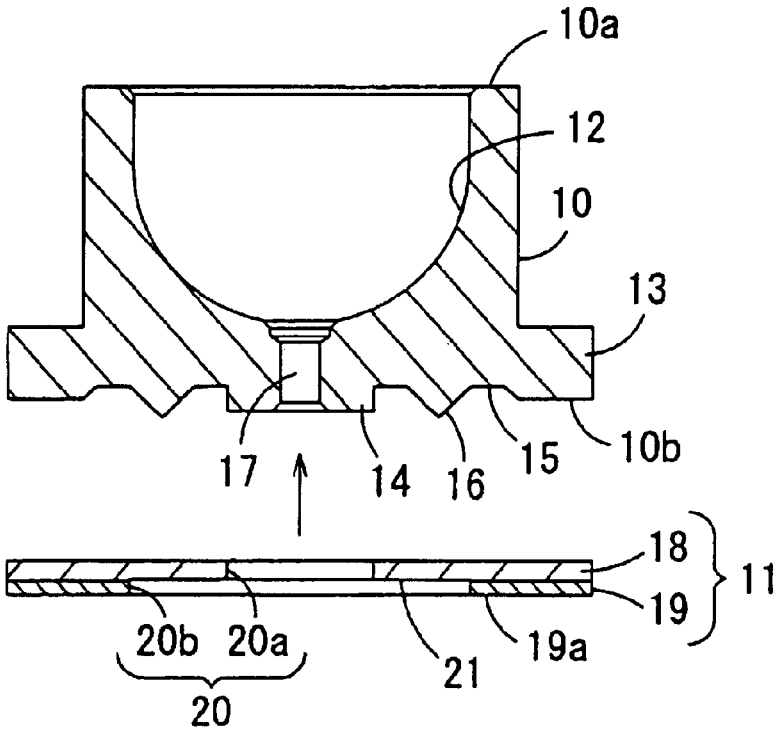
FIG. 1 is a cross-sectional view of a hydraulic apparatus shoe before welding a sliding-contact plate, according to the first embodiment of the present invention.
Figure 2:
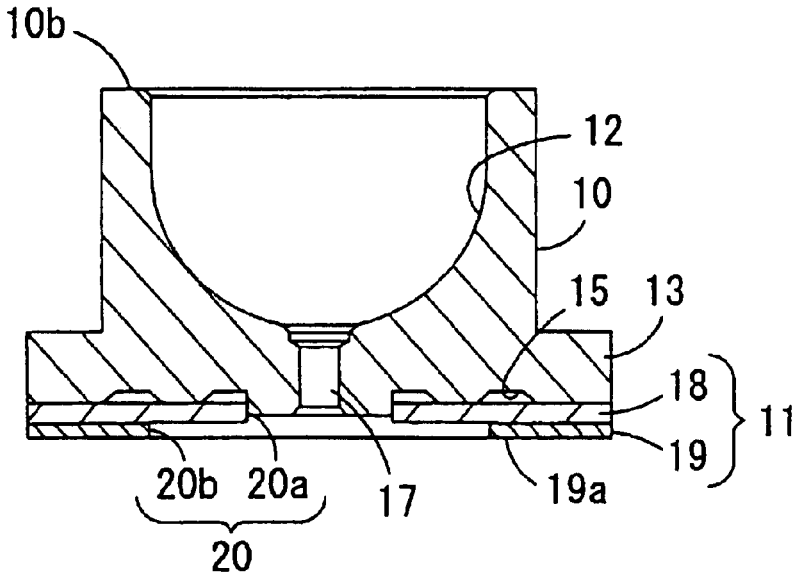
FIG. 2 is a cross-sectional view of FIG. 1 after welding.
Figure 3:
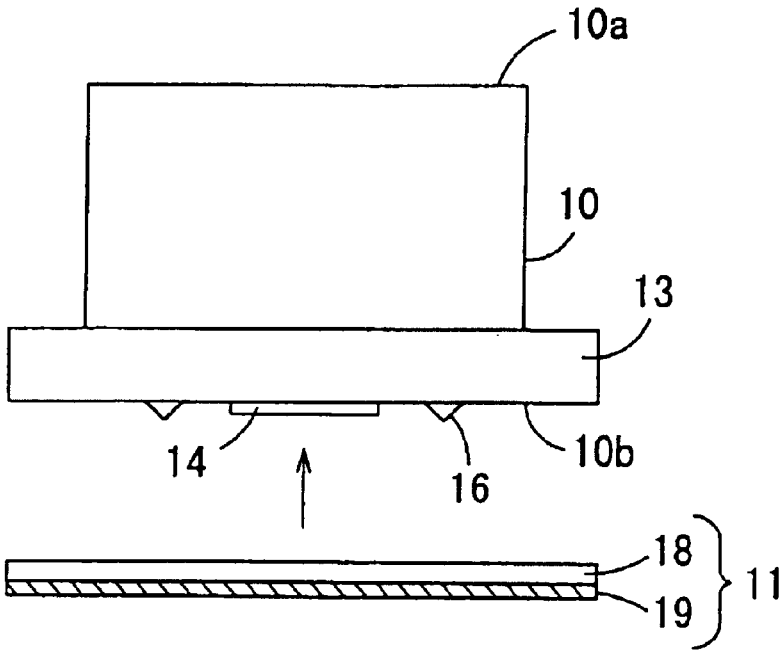
FIG. 3 is a lateral view of a hydraulic apparatus shoe before welding a sliding-contact plate.
Figure 4:
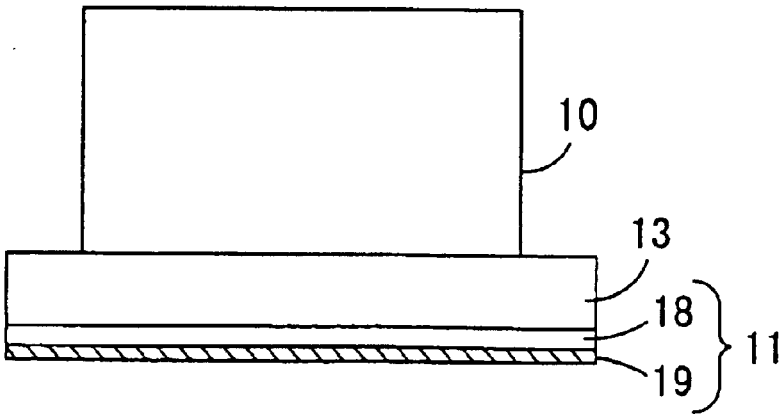
FIG. 4 is a lateral view of FIG. 3 after welding.
Figure 6:
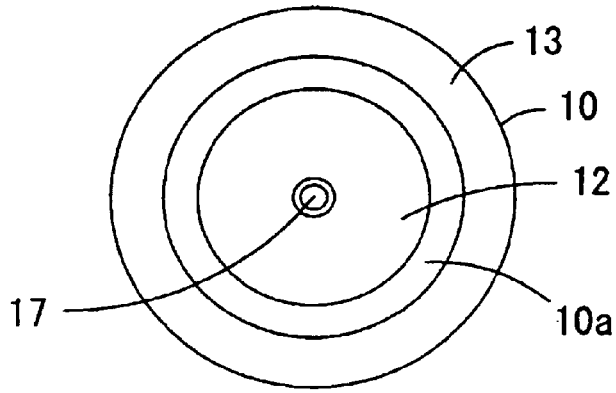
FIG. 6 is a plane view of FIG. 5.
Figure 5:
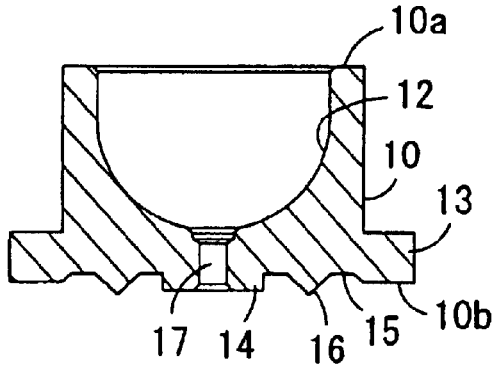
FIG. 5 is a cross-sectional view of a main body.
Figure 7:
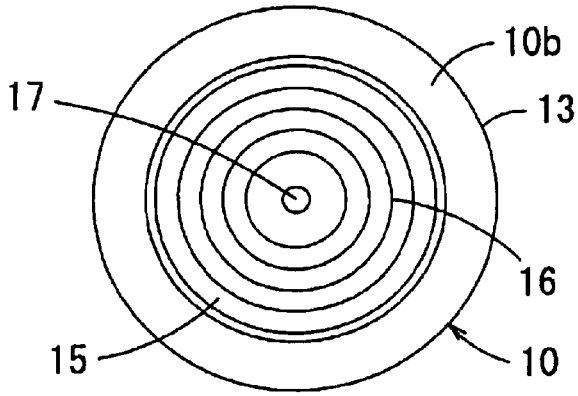
FIG. 7 is a bottom view of FIG. 5.

This shoe of the hydraulic apparatus comprises a main body 10 and a sliding-contact plate 11 as shown in FIGS. 1 and 2. The main body 10 is provided with a concave spherical surface 12 for slidably engaging the sphere 6 on its one side 10*a* and a protruding locking portion 14 for positioning on its opposite side 10*b* as shown in FIGS. 5 to 7, and according to this embodiment the main body 10 is made of for example a steel material and the concave spherical surface 12 is formed to be deeper than its radius of curvature, enabling to slightly contract an end portion of the opening after introducing the sphere 6 to prevent it from separating. At a bottom portion of the concave spherical surface 12 an oil path 17 is penetrating through to the opposite side. The opposite side 10*b* of the main body 10 comprises a collar portion 13 which enlarges an area of the opposite side 10*b*, and the locking portion 14 of the opposite side 10*b* is the protruding portion provided at a central portion of the opposite side 10*b* of the main body 10, and through a center of the protruding portion an end portion of the oil path 17 is penetrating, around which a ring-shaped recess 15 is formed, provided with a welding ring portion 16 thereon with a hill-shaped cross-section projecting higher than a surface of the opposite side 10*b*. The main body 10 can be processed for example by a lathe.

Figure 9:
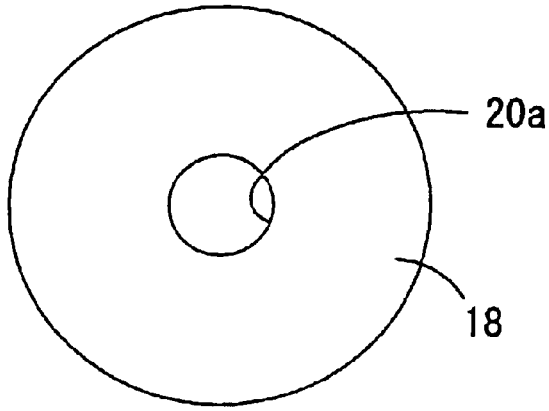
FIG. 9 is a plane view of FIG. 8.
Figure 8:
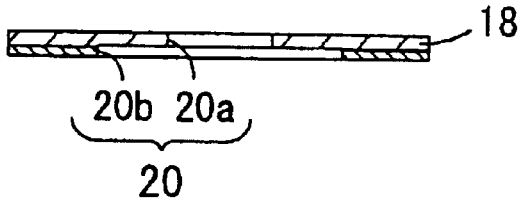
FIG. 8 is a cross-sectional view of a sliding-contact plate.
Figure 10:
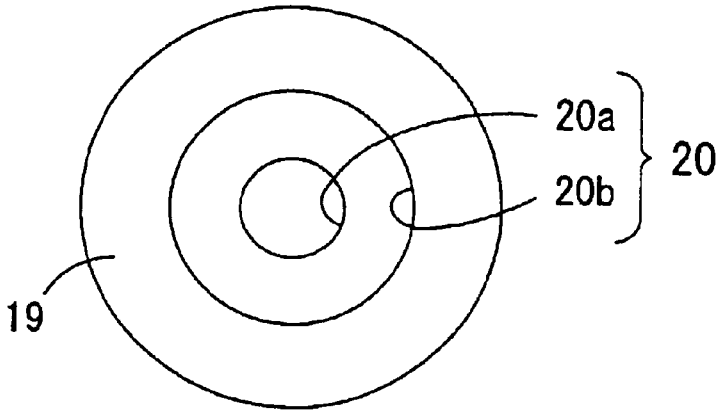
FIG. 10 is a bottom view of FIG. 8.

The sliding-contact plate 11 according to this embodiment is a bimetal washer of layered structure comprising a first layer 18 and a second layer 19 as shown in FIGS. 8 to 10, and it is so to say a donut-shaped washer as subsequently described. The first layer 18 is provided with an engaging portion 20 for positioning to be engaged with the locking portion 14 so as to remain in contact with the opposite side 10*b*, and is made of for example an iron family material and the engaging portion 20 is a bore portion to be engaged with a protruding portion. The second layer 19 is laminated on the first layer 18 leaving uncovered the welding portion 21 on the first layer 18, and its surface serves as a sliding-contact surface 19*a* with the swash plate, and is made of for example a copper alloy family metal. The first layer 18 and the second layer 19 are both disks and either they are of the same outer diameter or the second layer 19 has a smaller outer diameter, and in both cases a bore diameter of the bore portion 20*b* of the second layer 19 constituting the engaging portion 20 is greater than a bore diameter of the bore portion 20*a* of the first layer 18. And the welding portion 21 of the first layer 18 is located inside the bore portion 20*b* of the second layer 19, thus securing a welding allowance. The first layer 18 is to be welded to the main body 10 at the welding portion 21, in which process according to this embodiment, spot welding is performed through the welding ring portion 16 with the sliding-contact plate 11 put in contact with the welding ring portion 16, while simultaneously the engaging portion 20 is engaged with the locking portion 14 and makes contact with the opposite side 10*b*, thus achieving mutual adherence.

Now method of manufacturing the shoe shall be described hereunder. The method comprises the steps of manufacturing the foregoing main body 10, manufacturing the sliding-contact plate 11, and engaging the sliding-contact plate 11 with the main body 10 and welding the first layer 18 to the main body 10 at the welding portion 21.

Now referring to FIGS. 12 through 18, the second embodiment of the invention shall be described hereunder. In this embodiment, electron beam welding, YAG laser welding or TIG welding, etc. is performed instead of spot welding of the first embodiment, which eliminates the need to provide the recessed portion 15 and welding ring portion 16 of the main body 10. Other aspects are identical with the first embodiment, therefore the same numerals are given to the same components in the drawings.

Figure 19:
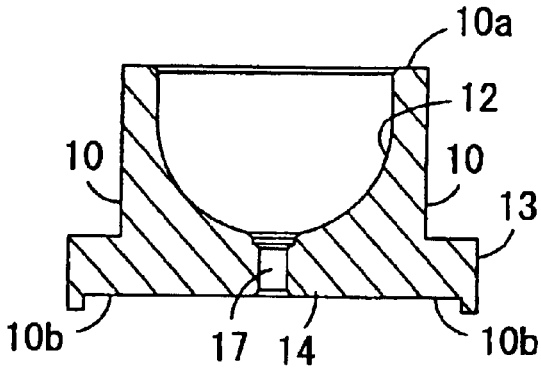
FIG. 19 is a cross-sectional view of a main body according to the third embodiment of the invention.
Figure 21:
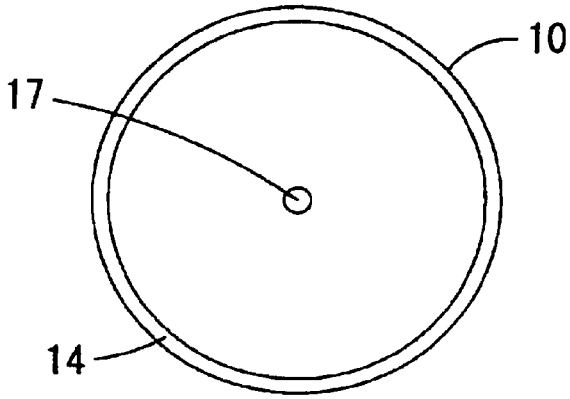
FIG. 21 is a bottom view of FIG. 19.
Figure 22:
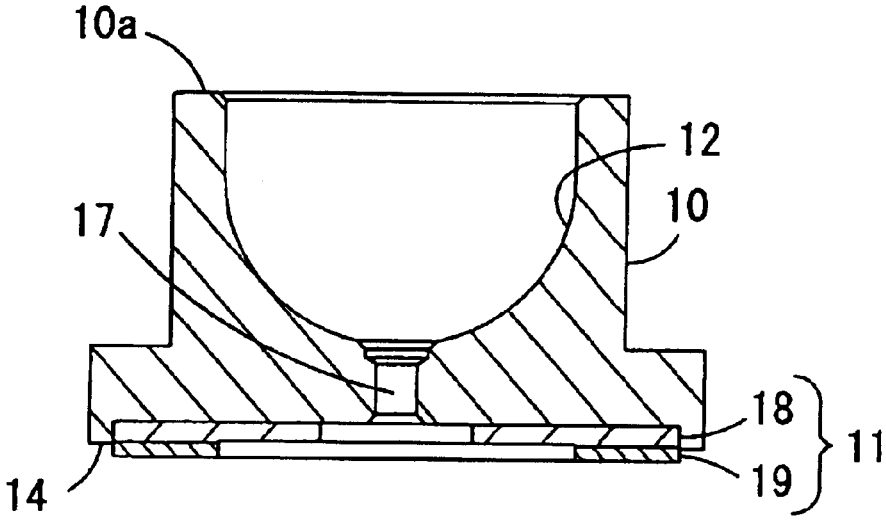
FIG. 22 is a cross-sectional view of the main body of FIG. 16 with a sliding-contact plate welded thereto.
Figure 24:
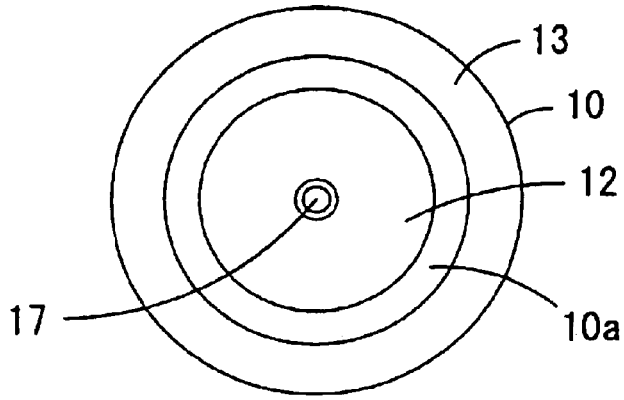
FIG. 24 is a plane view of FIG. 23.
Figure 23:
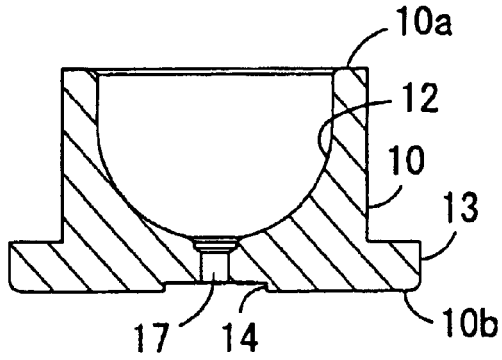
FIG. 23 is a cross-sectional view of a main body according to the fourth embodiment of the invention.
Figure 25:
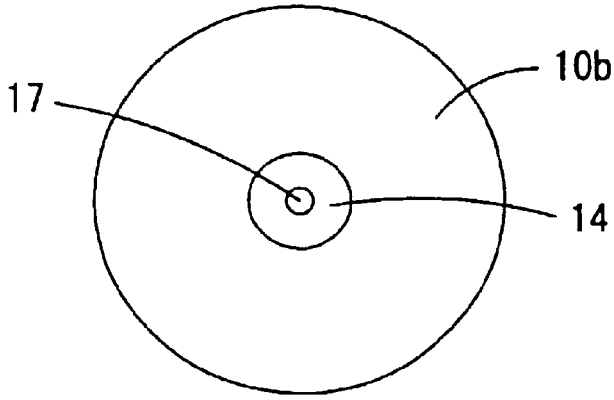
FIG. 25 is a bottom view of FIG. 23.
Figure 27:
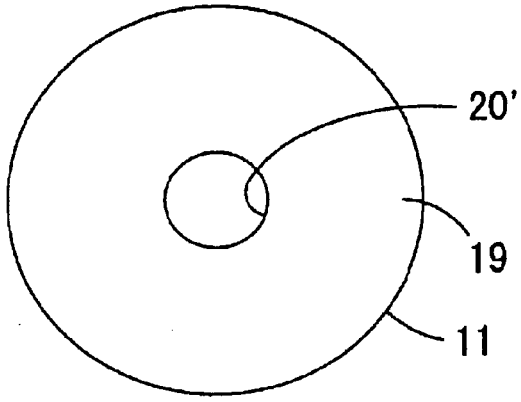
FIG. 27 is a plane view of FIG. 26.
Figure 26:
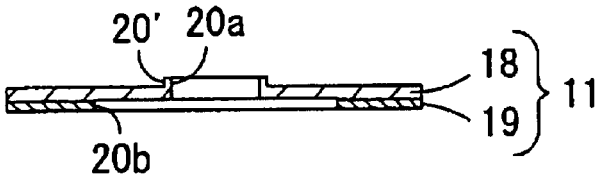
FIG. 26 is a cross-sectional view of a sliding-contact plate.
Figure 28:
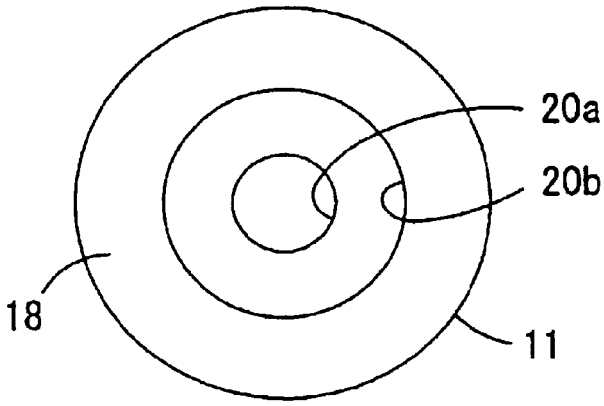
FIG. 28 is a bottom view of FIG. 26.
Figure 29:
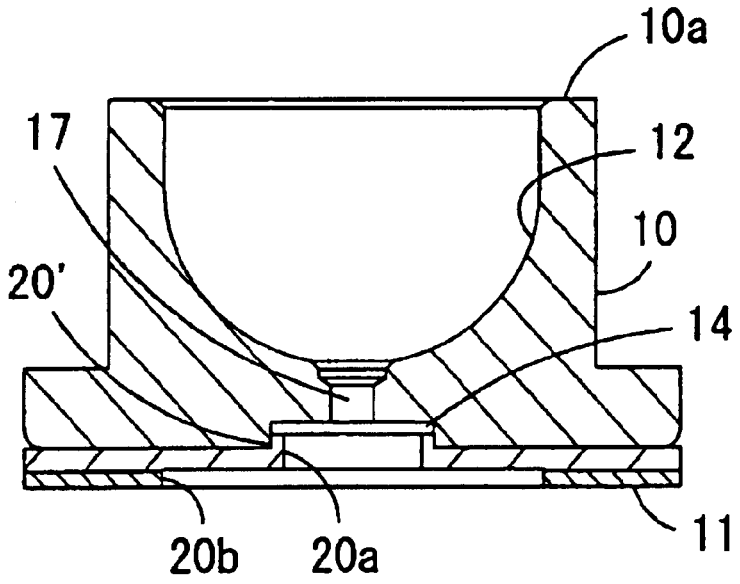
FIG. 29 is a cross-sectional view of the main body of FIG. 23 with a sliding-contact plate welded thereto.

The third embodiment of the invention shall now be described referring to FIGS. 19 and 22. In this embodiment, the locking portion 14 of the first and the second embodiments is provided in a ring shape protruding along an outer circumferential portion of the opposite side 10*b* of the main body 10, while the engaging portion 20 is obtained through making an outer diameter of the sliding-contact plate 11 substantially the same as or slightly smaller than an inner diameter of the locking portion 14. Other aspects are identical with the second embodiment, while it is also possible to perform spot welding as in the first embodiment.

The fourth embodiment of the invention shall now be described referring to FIGS. 23 through 29. This embodiment is a variation from the second embodiment, wherein the locking portion 14 is provided in a recessed configuration, while the bore portion 20*a* of the first layer 18 and the bore portion 20*b* of the second layer 19 of the sliding-contact plate 11 are left unchanged and an engaging portion 20' is provided in a ring shape protruding along a border portion of the bore portion 20*a*, to be fitted with the locking portion 14. Other aspects are identical with the second embodiment, while it is also possible to perform spot welding as in the first embodiment.

Figure 30:
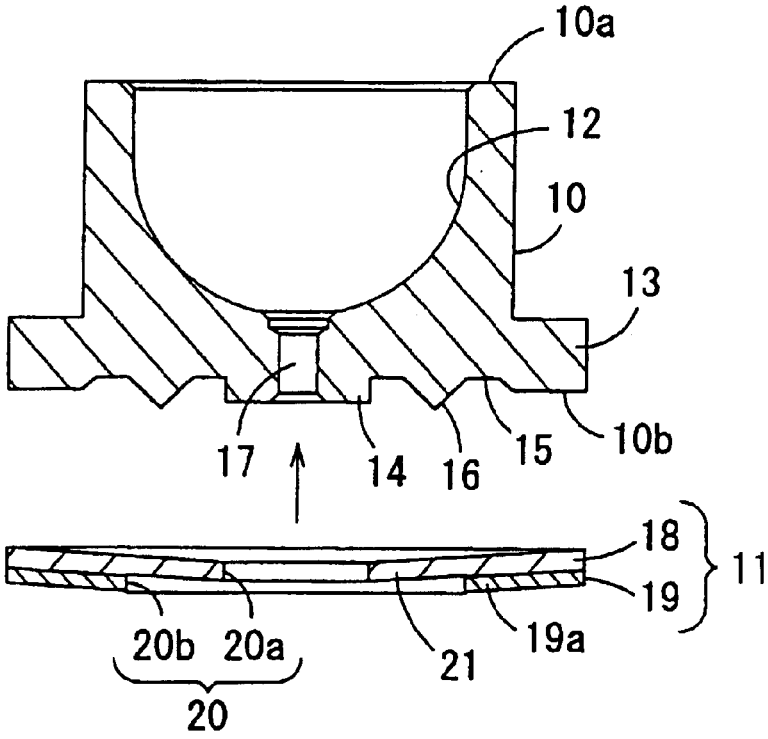
FIG. 30 is a cross-sectional view of a hydraulic apparatus shoe before welding a sliding-contact plate, according to the fifth embodiment of the invention.
Figure 31:
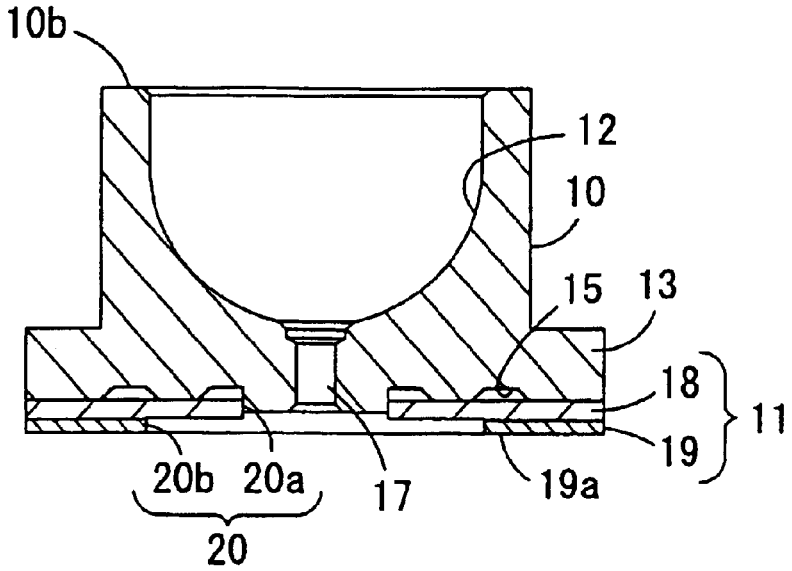
FIG. 31 is a cross-sectional view of FIG. 30 after welding.

The fifth embodiment of the invention shall now be described referring to FIGS. 30 and 31. In this embodiment, the sliding-contact plate 11 is plastically deformed so that a surface of the first layer 18 becomes concave and a surface of the second layer 19 becomes convex, while the opposite side 10*b* of the main body 10 remains flat as in the first embodiment. The sliding-contact plate 11 is pressed against the opposite side 10*b* of the main body 10, so that the sliding-contact plate 11 remains in contact with the opposite side 10*b* in a flat shape. During such process, spot welding is performed through the welding ring portion 16 with the first layer 18 put in contact with the welding ring portion 16, so that the first layer 18 is pressed against the main body 10 before the sliding-contact plate 11 becomes of a flat shape, following which the welding ring portion 16 is softened to allow the first bore portion 20*a* of the engaging portion 20 to be engaged with the locking portion 14 and make contact with the opposite side 10*b*, thus achieving a flat shape of the sliding-contact plate 11 and mutual adherence.

According to the fifth embodiment, since perimetrical portions of the sliding-contact plate 11 is under a pressing force applied in a direction of the opposite side 10*b* of the main body 10, the perimetrical portions of the sliding-contact plate 11 can be prevented from bending backward to be separated from the opposite side 10*b* of the main body 10 during operation. Other aspects are the same as the first embodiment.

Figure 32:
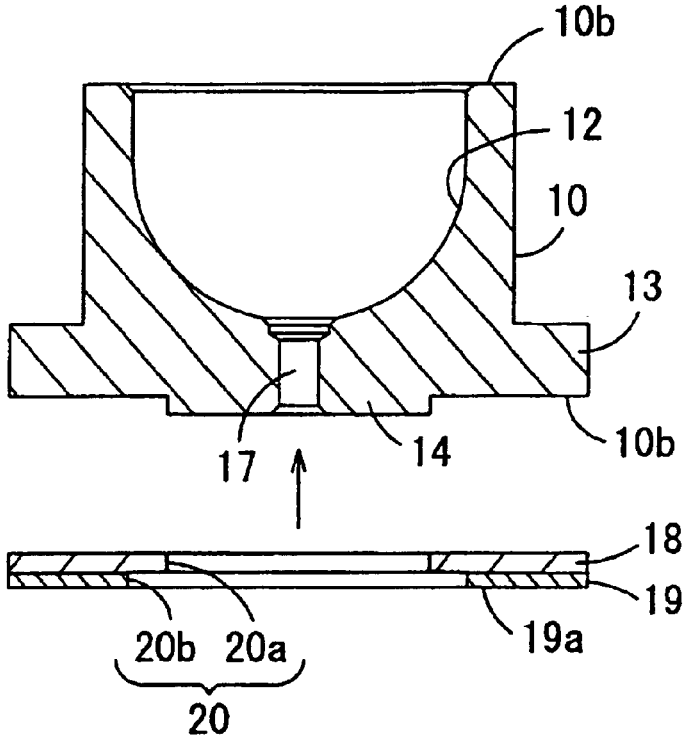
FIG. 32 is a cross-sectional view of a hydraulic apparatus shoe before welding a sliding-contact plate, according to the sixth embodiment of the invention.
Figure 33:
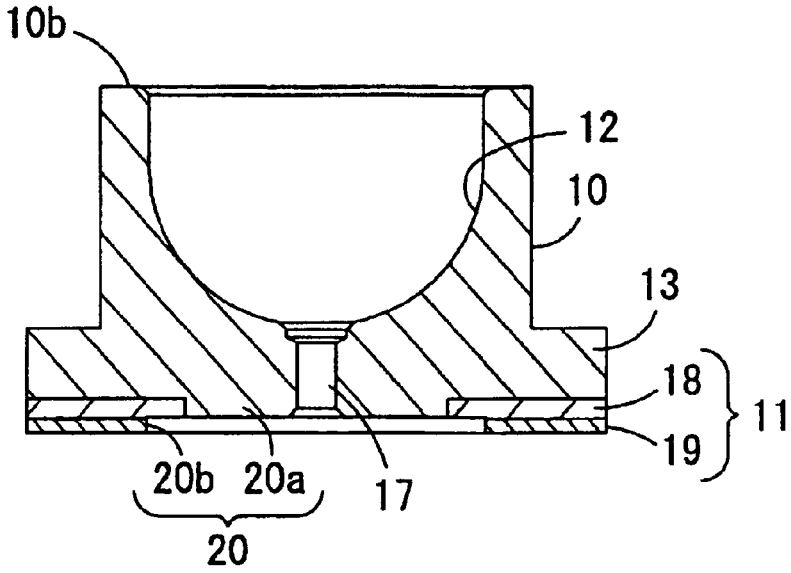
FIG. 33 is a cross-sectional view of FIG. 32 after welding.

The sixth embodiment of the invention shall now be described referring to FIGS. 32 and 33. In this embodiment, an outer diameter of the locking portion 14 of the main body 10 in the second embodiment is made greater but smaller than the second bore portion 20*b*, and the first bore portion 20*a* is also made greater according to the locking portion 14, so that the first bore portion 20*a* serves as the engaging portion 20 to be fitted with the locking portion 14. Further a ring-shaped fitted contacting portion between the locking portion 14 and the first bore portion 20*a* of the first layer 18 is used as welding portion 21, and for example laser welding is performed along the fitted contacting portion, to achieve mutual adherence.

According to this embodiment, since a diameter of the first bore portion 20*a* becomes greater, material for the sliding-contact plate of a bimetal structure can be saved. Other aspects are the same as the second embodiment.

Figure 34:
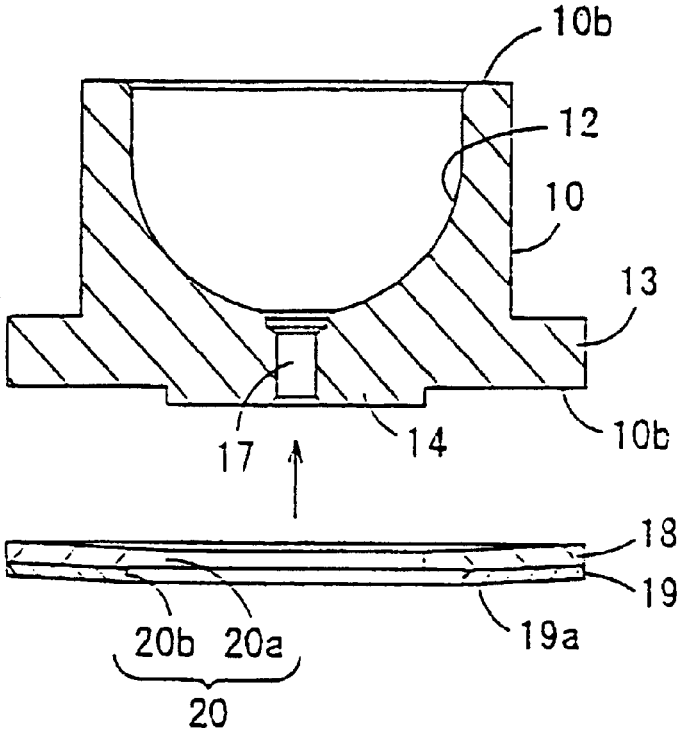
FIG. 34 is a cross-sectional view of a hydraulic apparatus shoe before welding a sliding-contact plate, according to the seventh embodiment of the invention.
Figure 35:
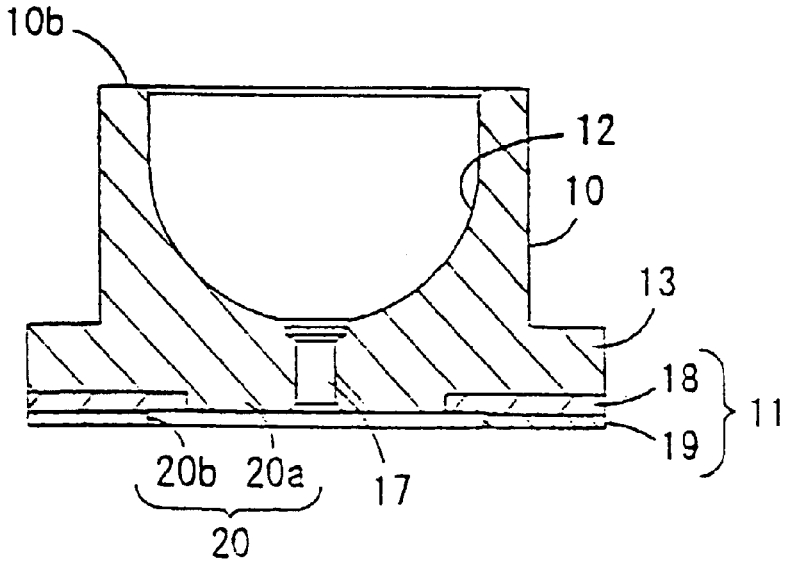
FIG. 35 is a cross-sectional view of FIG. 34 after welding.
Figure 36:
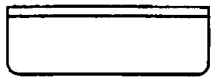
FIGS. 36 through 47 are explanatory drawings for explaining a conventional manufacturing steps of a shoe.
Figure 37:
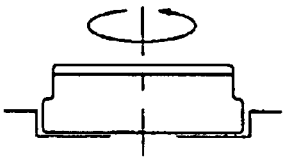
PRIOR ART FIG. 37
Figure 38:
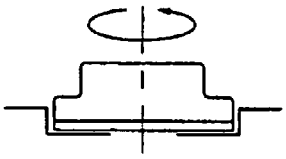
PRIOR ART FIG. 38
Figure 39:
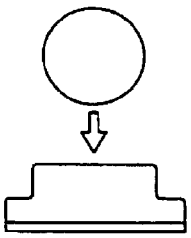
PRIOR ART FIG. 39
Figure 40:
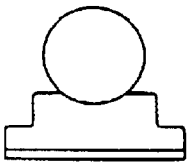
PRIOR ART FIG. 40
Figure 41:
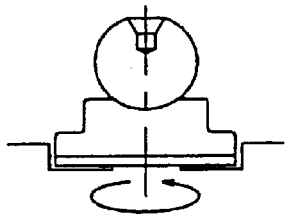
Figure 42:
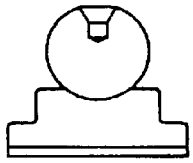
PRIOR ART FIG. 42
Figure 43:
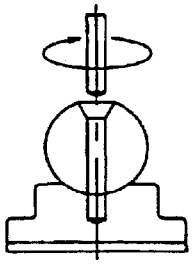
PRIOR ART FIG. 43
Figure 44:
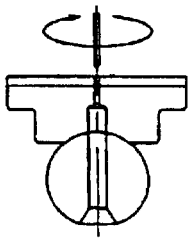
PRIOR ART FIG. 44
Figure 45:
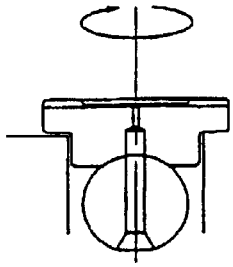
Figure 46:
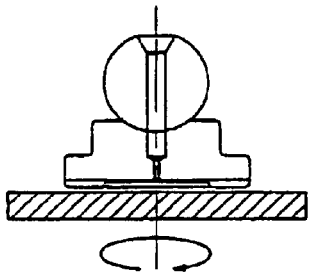
PRIOR ART FIG. 46
Figure 47:
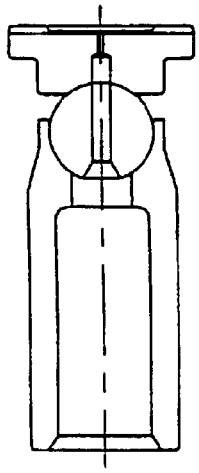
PRIOR ART FIG. 47

The seventh embodiment of the invention shall now be described referring to FIGS. 34 and 35. As a variation from the sixth embodiment, the sliding-contact plate 11 is plastically deformed so that the face side and the back side constitute a concavo/convex configuration as in the fifth embodiment, and is pressed against the opposite side 10*b* of the main body 10 to achieve a flat shape, and for example laser welding is performed as in the sixth embodiment. Therefore, the sliding-contact plate 11 can be prevented from bending backward during operation, as in the fifth embodiment.

In addition, according to the invention the main body may be provided with a sphere and the piston may be provided with a concave spherical surface.

What is claimed is:

1. A shoe for a hydraulic apparatus, comprising a main body provided on one side thereof with (i) a concave spherical surface to which a sphere is slidably engaged or (ii) a sphere, and on the opposite side thereof with either a recessed or protruding locking portion; and a sliding-contact plate provided with an engaging portion by which to be engaged with said locking portion to make contact with said opposite side; wherein said sliding-contact plate comprises a first layer that makes contact with said opposite side of said main body and a second layer laminated on a region of said first layer except a prescribed welding portion so that its surface serves as a sliding-contact surface; and said first layer is welded to said main body at said prescribed welding portion.

2. The shoe for a hydraulic apparatus as set forth in claim 1, wherein said locking portion is a protruding portion located at a central portion of said opposite side of said main body, and said engaging portion is a bore portion by which to be engaged with said protruding portion.

3. The shoe for a hydraulic apparatus as set forth in claim 2, wherein said bore portion is formed on said first layer and said second layer, and a bore diameter of said second layer is greater than a bore diameter of said first layer, and said welding portion of said first layer are located inside an inner circumferential portion of said second layer.

4. The shoe for a hydraulic apparatus as set forth in claim 3, wherein said opposite side of said main body is a plain surface, and said sliding-contact plate is plastically deformed so that a surface of said first layer becomes concave and a surface of said second layer convex, and said sliding-contact plate is pressed against said opposite side of said main body in a flat shape to remain in contact with said opposite side.

5. The shoe for a hydraulic apparatus as set forth in claim 3 or 4, wherein said welding portion corresponds to a contacting portion of said protruding portion and said bore portion of said first layer.

6. A method of manufacturing a shoe for a hydraulic apparatus, comprising the steps of: manufacturing a main body provided on one side thereof with (i) a concave spherical surface to which a sphere is slidably engaged or (ii) a sphere and on said opposite side thereof with either recessed or protruding locking portion; manufacturing a sliding-contact plate comprising a first layer that makes contact with said opposite side of said main body and a second layer laminated on a region of said first layer except a prescribed welding portion so that its surface serves as a sliding-contact surface, and having an engaging portion by which to be engaged with said locking portion at least in said first layer; and engaging said engaging portion of said sliding-contact plate with said locking portion of said main body and welding said prescribed portion of said first layer to said main body.

* * * * *